US011795700B2

(12) United States Patent
Hurson

(10) Patent No.: US 11,795,700 B2
(45) Date of Patent: Oct. 24, 2023

(54) FLOOR TILE WITH WATERPROOF CONNECTION

(71) Applicant: Niall Hurson, Warrenpoint (GB)

(72) Inventor: Niall Hurson, Warrenpoint (GB)

(73) Assignee: R-TEK MANUFACTURING LIMITED, Benburb (GB)

( * ) Notice: Subject to any disclaimer, the term of this patent is extended or adjusted under 35 U.S.C. 154(b) by 66 days.

(21) Appl. No.: 17/529,505

(22) PCT Filed: Jun. 11, 2020

(86) PCT No.: PCT/EP2020/066225
§ 371 (c)(1),
(2) Date: Nov. 18, 2021

(87) PCT Pub. No.: WO2020/254192
PCT Pub. Date: Dec. 24, 2020

(65) Prior Publication Data

US 2022/0186504 A1 Jun. 16, 2022

(30) Foreign Application Priority Data

Jun. 18, 2019 (GB) ..... 1908672

(51) Int. Cl.
*E04F 15/02* (2006.01)
*E04F 15/10* (2006.01)

(52) U.S. Cl.
CPC .. *E04F 15/02016* (2013.01); *E04F 15/02038* (2013.01); *E04F 15/02188* (2013.01);
(Continued)

(58) Field of Classification Search
CPC ..... E04F 15/02016; E04F 15/02188; E04F 15/107; E04F 2201/098; E04F 2201/0138;
(Continued)

(56) References Cited

U.S. PATENT DOCUMENTS 5,323,575 A * 6/1994 Yeh ..... E04F 15/02 52/390
6,526,705 B1 * 3/2003 MacDonald ..... E04F 15/02 428/44

(Continued)

FOREIGN PATENT DOCUMENTS

EP 0044371 A1 1/1982
FR 3003587 A1 9/2014

(Continued)

OTHER PUBLICATIONS

Hurson, Patent Application No. GB1908672.7 filed in the United Kingdom, Examiner Search Report dated Jul. 14, 2020, 4 pages.

(Continued)

*Primary Examiner* — Brent W Herring
(74) *Attorney, Agent, or Firm* — Brian S. Steinberger; Hilary F. Steinberger; Law Offices of Brian S. Steinberaer. P.A.

(57) ABSTRACT

A floor tile comprising a base substrate and a laminate layer, wherein the base substrate comprises a top layer with a laminate layer receiver on a top surface thereof and a bottom layer with connecting means for engaging with connecting means of a base substrate of a further tile to form an interconnected flooring system. The top layer of the base substrate extends over connecting means on at least one side of the base substrate, characterized in that the base substrate further comprises waterproofing means for engaging with waterproofing means of a base substrate of at least one further tile to provide a waterproof seal between the tile and at least one further tile.

20 Claims, 10 Drawing Sheets

(52) U.S. Cl.
CPC .... *E04F 15/107* (2013.01); *E04F 2201/0138* (2013.01); *E04F 2201/091* (2013.01); *E04F 2201/095* (2013.01); *E04F 2201/098* (2013.01)

(58) Field of Classification Search
CPC ..... E04F 2203/065; E04F 2201/095; E04F 15/105; E04F 15/02038; E04F 2201/091
USPC ..... 52/578, 588.1, 387, 592.1, 385, 589.1
See application file for complete search history.

(56) References Cited

U.S. PATENT DOCUMENTS

| | | | | |
|---|---|---|---|---|
| 7,131,242 | B2 * | 11/2006 | Martensson | E04F 15/02 52/592.1 |
| 8,266,857 | B2 * | 9/2012 | David | B44C 5/04 52/177 |
| 9,771,722 | B2 | 9/2017 | Hurson | |
| 2005/0051061 | A1 * | 3/2005 | Smith | E04F 15/02194 108/84 |
| 2005/0183370 | A1 * | 8/2005 | Cripps | E04F 15/105 52/591.5 |
| 2007/0022689 | A1 * | 2/2007 | Thrush | E04F 13/18 52/392 |
| 2010/0257801 | A1 * | 10/2010 | Anderson | E04F 15/087 52/391 |
| 2013/0139464 | A1 * | 6/2013 | DeLong | E04B 5/00 52/588.1 |
| 2014/0245681 | A1 | 9/2014 | Carrubba | |
| 2015/0284965 | A1 * | 10/2015 | Hurson | B32B 37/24 156/60 |
| 2018/0030667 | A1 * | 2/2018 | Penland, Jr. | B32B 3/06 |

FOREIGN PATENT DOCUMENTS

| | | | |
|---|---|---|---|
| WO | 9934075 | A1 | 7/1999 |
| WO | 2010138616 | A2 | 12/2010 |
| WO | 2017202486 | A1 | 11/2017 |

OTHER PUBLICATIONS

Hurson, PCT Patent Application No. PCT/EP2020/066225 filed Jun. 11, 2020, International Search Report dated Oct. 7, 2020, 14 pages.

* cited by examiner

FLOOR TILE WITH WATERPROOF CONNECTION

CROSS REFERENCE TO RELATED APPLICATIONS

This application is a continuation of PCT/EP2020/066225, filed Jun. 11, 2020, which claims the benefit of priority to United Kingdom Patent Application GB 1908672.7 filed Jun. 18, 2019. The entire disclosure of each of the applications listed in this paragraph are incorporated herein by specific reference thereto.

FIELD OF INVENTION

The present invention relates to a floor tile. More particularly, the present invention relates to a waterproof modular flooring system.

BACKGROUND AND PRIOR ART

Modular flooring systems having tiles with an interlocking structure are known in the prior art. For example, EP 2812509 discloses a floor tile with grout effect and hidden interlock.

However, whilst such prior art interconnecting tiles are watertight, they are not fully waterproof. That is, water can seep through the join between tiles and cause the tiles to buckle and/or lift.

It is therefore an object of the present invention to provide a tile which alleviates the above-mentioned disadvantages and/or provides a suitable alternative.

Thus, the need exists for solutions to the above problems with the prior art.

SUMMARY OF THE INVENTION

The present invention relates to a new generation of loose lay tiles with hidden interlock for use in forming a waterproof floor covering. When placed together, the tiles according to the invention provide a waterproof floor covering such that each join between tiles, whether between adjacent tiles or between diagonally placed tiles, does not permit water ingress.

Accordingly, the present invention is a tile comprising a base substrate and a laminate layer, wherein the base substrate comprises a top layer with a laminate layer receiver on a top surface thereof and a bottom layer with connecting means for engaging with connecting means of a base substrate of a further tile to form an interconnected flooring system. The top layer of the base substrate extends over connecting means on at least one side of the base substrate, characterized in that the base substrate further comprises waterproofing means for engaging with waterproofing means of a base substrate of at least one further tile to provide a waterproof seal between the tile and at the least one further tile wherein the waterproofing means comprises at least one upstanding flexible seal fin on a top surface of the bottom layer of the base substrate, a sealing channel on the underside of the top layer of the base substrate and a spud depending from the sealing channel, wherein the upstanding flexible seal fin is for engaging with the sealing channel of a further tile, wherein the sealing channel is for accepting an upstanding flexible seal fin of at least one other further tile and wherein the spud is for engagement with yet a further tile to encourage the upstanding flexible seal fin of the tile with which it engages into a sealing channel of one of the other tiles.

The tiles according to the invention are loose lay tiles. That is, no adhesive or grout is required when laying the tiles to form an interconnected floor. The tiles according to the invention have moulding grout edging thus providing ceramic aesthetics as well as being completely waterproof, easy to install and reusable due to the fact they are not damaged upon removal.

When tiles according to the invention are placed together, the top layer of one tile covers the connecting means of at least one adjacent tile to provide a hidden connection between the tiles. Additionally, the waterproofing means of the first tile engages with waterproofing means of at least the second tile to provide a waterproof connection between the tiles.

Due to the top layer of the base substrate extending over connecting means on at least one side of the base substrate, the upstanding flexible seal fin being on a top surface of the bottom layer of the base substrate and the sealing channel being on the underside of the top layer of the base substrate, the upstanding flexible seal fin and sealing channel are on different sides of the base substrate.

When tiles according to the invention are placed together, the top layer of tile one covers the connecting means of tile two to provide a hidden connection between the tiles and an upstanding flexible seal fin of tile two engages with a sealing channel of tile one to provide a waterproof connection between the tiles. When tile three is placed together with tile two and diagonal to tile one, the top layer of tile three covers the connecting means of tile two, the upstanding fin of tile two engages with the sealing channel of tile three and the spud of tile one encourages this engagement.

In a preferred embodiment, the laminate layer receiver comprises upstanding edges defining a rim at a perimeter of the top layer of the base substrate for aligning the laminate layer on the base substrate. In a particularly preferred embodiment, the rim of the laminate layer receiver extends around the full perimeter of the top layer of the base substrate.

In a preferred embodiment, the connecting means comprises a plurality of protruding tongues and grooves at adjacent sides of the bottom layer of the base substrate, wherein a protruding tongue of the base substrate is preferably engaged in a groove of the base substrate of another tile to connect adjacent tiles to form the flooring system.

In a preferred embodiment, the top layer of the base substrate extends over connecting means on two sides of the base substrate, for example the top layer of the base substrate extends over connecting means on two adjacent sides of the base substrate rather than on two opposing sides.

The tile has at least one upstanding flexible seal fin on a top surface of the bottom layer of the base substrate. Preferably the at least one upstanding flexible seal fin extends from the top surface of the bottom layer such that it does not touch the top layer of the base substrate.

The tile preferably has a plurality of upstanding flexible seal fins which do not touch each other. In a particularly preferred embodiment, the tile has four upstanding flexible seal fins separated by a gap for receiving the spud of another tile.

In a preferred embodiment, the or each upstanding flexible seal fin independently is tapered, particularly preferably wherein the or each upstanding flexible seal fin independently is tapered such that the cross-section thereof is a triangle, e.g. a right-angled triangle. However, this is not to be considered limiting and, although less preferred, the or each upstanding flexible seal fin independently may alternatively have a non-tapered or curved cross-section.

The or each upstanding flexible seal fin independently is preferably shorter than the height of the top layer of the base substrate, e.g., shorter than the height of the laminate layer receiver. In a preferred embodiment, the or each upstanding flexible seal fin independently is about half the height of the laminate layer receiver.

The upstanding flexible seal fin is encouraged into the sealing channel by the spud of another tile preferably such that the upstanding flexible seal fin lies flush against the interior surface of the sealing channel.

The tile has at least one sealing channel on the underside of the top layer of the base substrate. Preferably the at least one sealing channel extends along the length of the tile.

In a preferred embodiment, the tile has two intersecting sealing channels. In this embodiment, the spud is preferably located offset from the intersection point of the two sealing channels.

Preferably, the or each sealing channel independently is for accepting two upstanding flexible seal fins, one from one further tile and one from another further tile.

In a preferred embodiment, the or each sealing channel independently has a semi-circular cross section. However, this is not to be considered limiting and the or each sealing channel independently may alternatively be otherwise curved, for example having a U-shaped cross section. In this preferred embodiment, the height of the or each upstanding flexible seal fin independently is shorter than the length of the curved cross section of the sealing channel, preferably wherein the height of the or each upstanding flexible seal fin independently is between about half and about three-quarters the length of the curved section of the sealing channel cross-section.

The spud is preferably a tapered protrusion such as a truncated conical protrusion. Alternatively, the spud may be a spherical protrusion. However, this is not considered to be limiting and any shape of spud which fulfils the requirement of encouraging the upstanding flexible seal fin of the tile with which it engages into a sealing channel of one of the other tiles is within the scope of the invention.

The spud preferably depends from the sealing channel such that the spud is flush with the underside of the top layer of the base substrate.

In another embodiment of the invention, engaging the connecting means of a tile with a further tile aligns and positions a side edge of the tile with the side edge of the further tile in a side by side arrangement. This provides a grout effect for the tiles when connected.

The base substrate of the tile according to the invention is preferably made of polyvinylchloride (PVC). In this preferred embodiment, the tiles provide ceramic aesthetics and vinyl performance.

The base substrate of the tiles according to the invention is preferably moulded in one piece.

The laminate layer of the tile according to the invention preferably comprises a PVC backing layer, a printed middle layer having a desired surface finish or effect for the tile, such as wood, porcelain, plastic etc. and a clear PVC top layer.

The method of forming a tile according to the invention preferably comprises the steps of:

forming a base substrate having a top layer with a laminate layer receiver;

applying an adhesive to a bottom surface of a laminate layer, preferably using a roller coater machine;

aligning the laminate layer within the laminate layer receiver such that the bottom surface of the laminate layer sits on the top surface of the substrate, and bonding the laminate layer to the substrate to form the tile, preferably applying pressure to the laminate layer on the base substrate, e.g., using a nip-roller machine.

Preferably, an injection moulding machine is used to form the base substrate.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

Certain preferred embodiments of the present invention will now be described, by way of example only, with reference to the accompanying drawings in which.

DESCRIPTION OF THE PREFERRED EMBODIMENTS

Figure 1B:
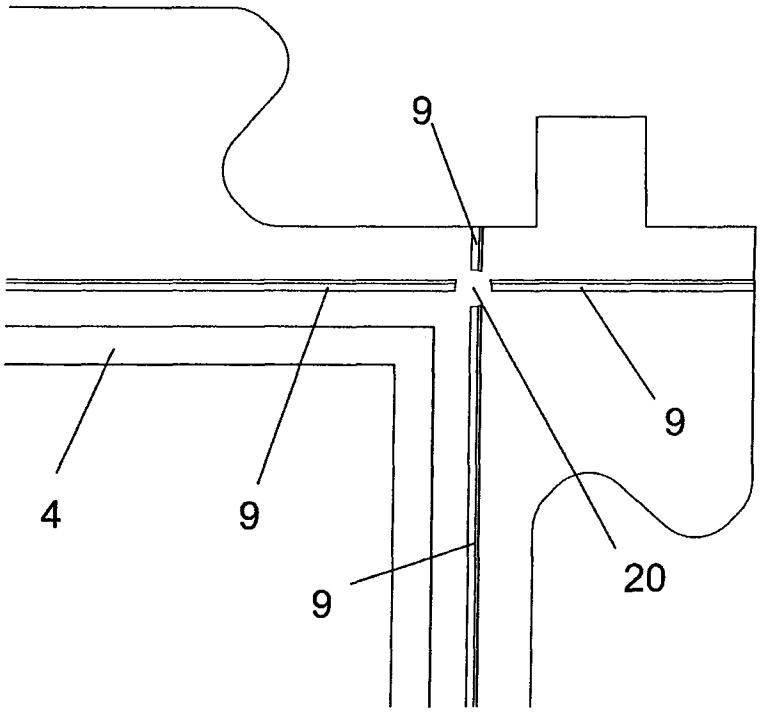
FIG. 1*b* is an enlarged view of corner A of the tile of FIG. 1*a*.
Figure 1A:
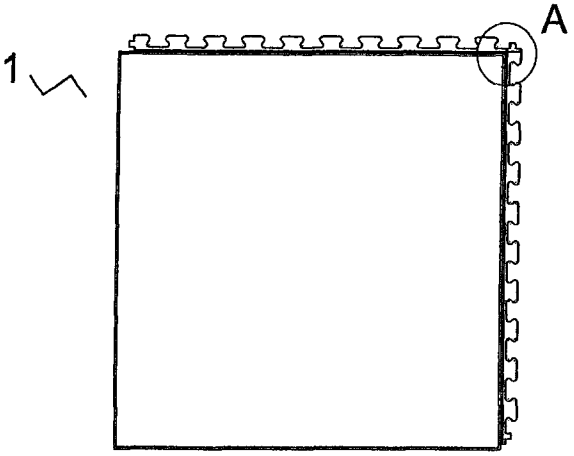
FIG. 1*a* is a plan view of a preferred tile according to the invention.
Figure 2:
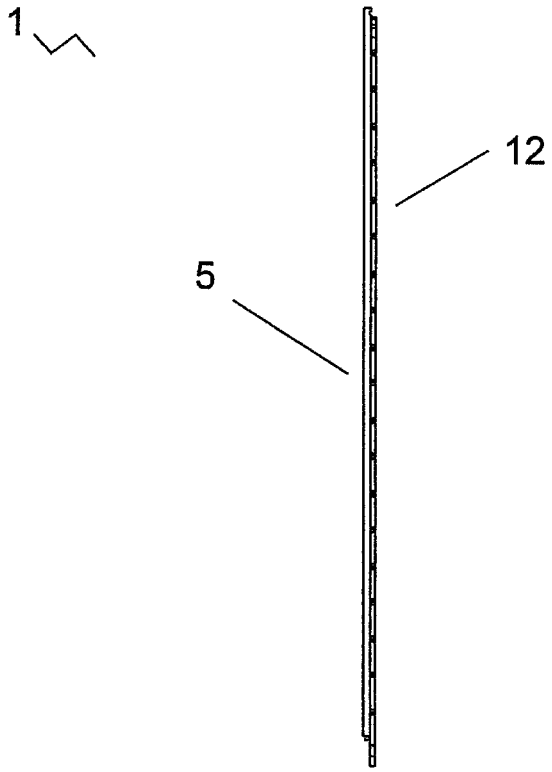
FIG. 2 is a side view of the tile in FIG. 1*a*.
Figure 3:
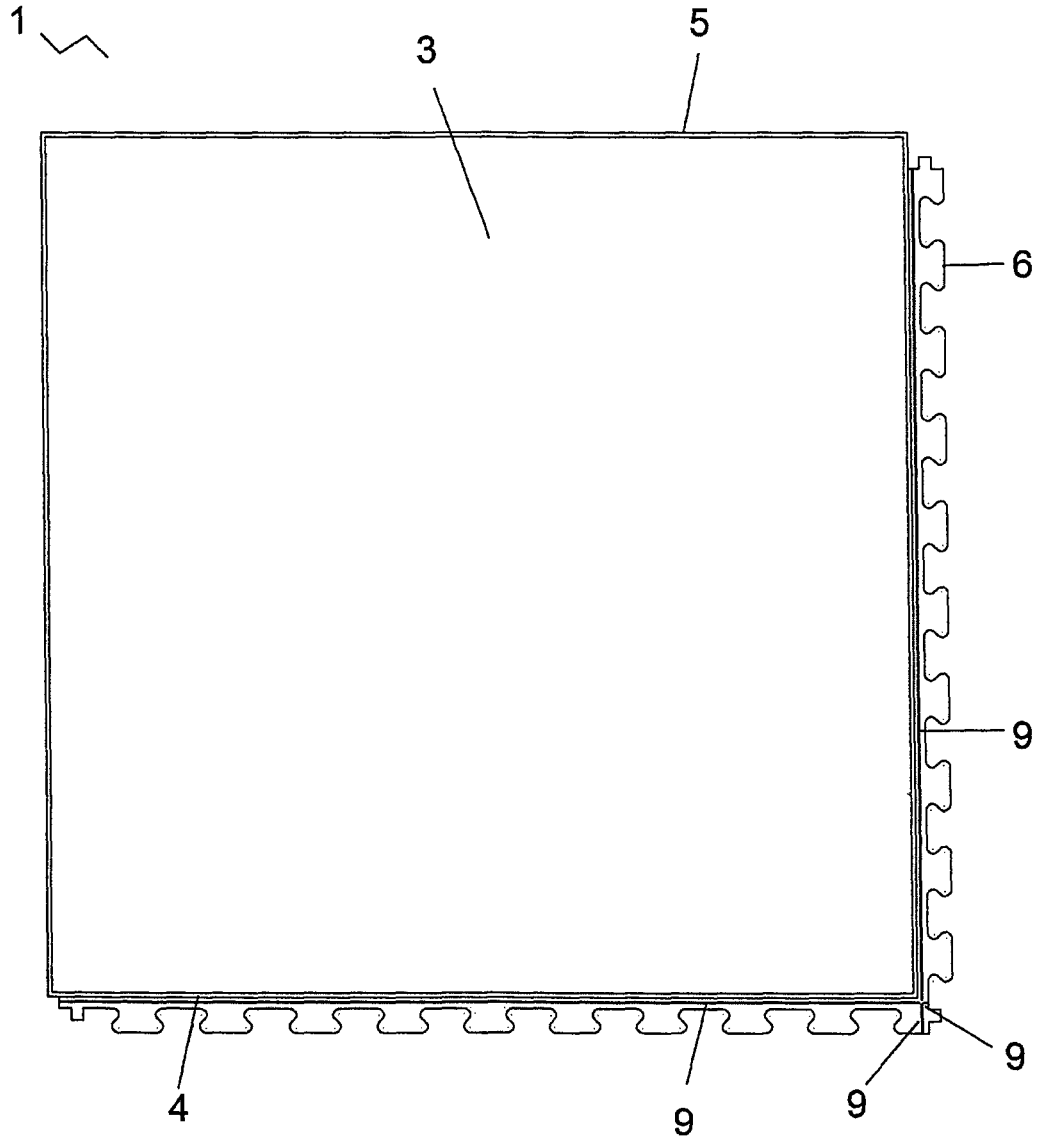
FIG. 3 is an enlarged plan view of the tile in FIG. 1*a*.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features.

For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

Various embodiments of the present invention will be described in detail with reference to the drawings, where like reference numerals represent like parts and assemblies throughout the several views.

A list of components will now be identified.

1 Tile
1' Tile
2 base substrate
3 laminate layer
4 laminate layer receiver
5 top layer
6 connecting means
7 tongues
8 grooves
9 flexible seal fins
10 two intersecting sealing channels
11 truncated conical protrusion
12 Bottom layer
13 Top surface of bottom layer 12
15 Top surface of top layer 5
16 underside of top layer 5
20 gap Referring to the drawings, there is shown a tile, indicated generally by the reference numeral 1, comprising a base substrate 2 and a laminate layer 3. Base substrate 2 has a top layer 5 and a bottom layer 12. Laminate layer receiver 4 is on a top surface 15 of top layer 5 for aligning laminate layer 3 on top layer 5. Bottom layer 12 has connecting means 6 for engaging with connecting means 6 of a base substrate 2 of a further tile 1' to form an interconnected flooring system (see FIGS. 9 and 10).

In the preferred embodiment shown in the drawings, top layer 5 of base substrate 2 extends over connecting means 6 on two adjacent sides of base substrate 2 and laminate layer receiver 4 is in the form of an upstanding edge defining a rim at a perimeter of top layer 5. In the instance shown, rim 4 extends around the full perimeter of top layer 5 of base substrate 2. Laminate layer 3 is preferably bonded to base substrate 2 within laminate layer receiver 4 using an adhesive which may be applied to laminate layer 3 or base substrate 2.

Connecting means 6 comprises a plurality of protruding tongues 7 and grooves 8 at adjacent sides of base substrate 2.

Base substrate 2 further comprises waterproofing means in the form of four upstanding flexible seal fins 9 which do not touch each other, two intersecting sealing channels 10 and a truncated conical protrusion 11.

Figure 4:
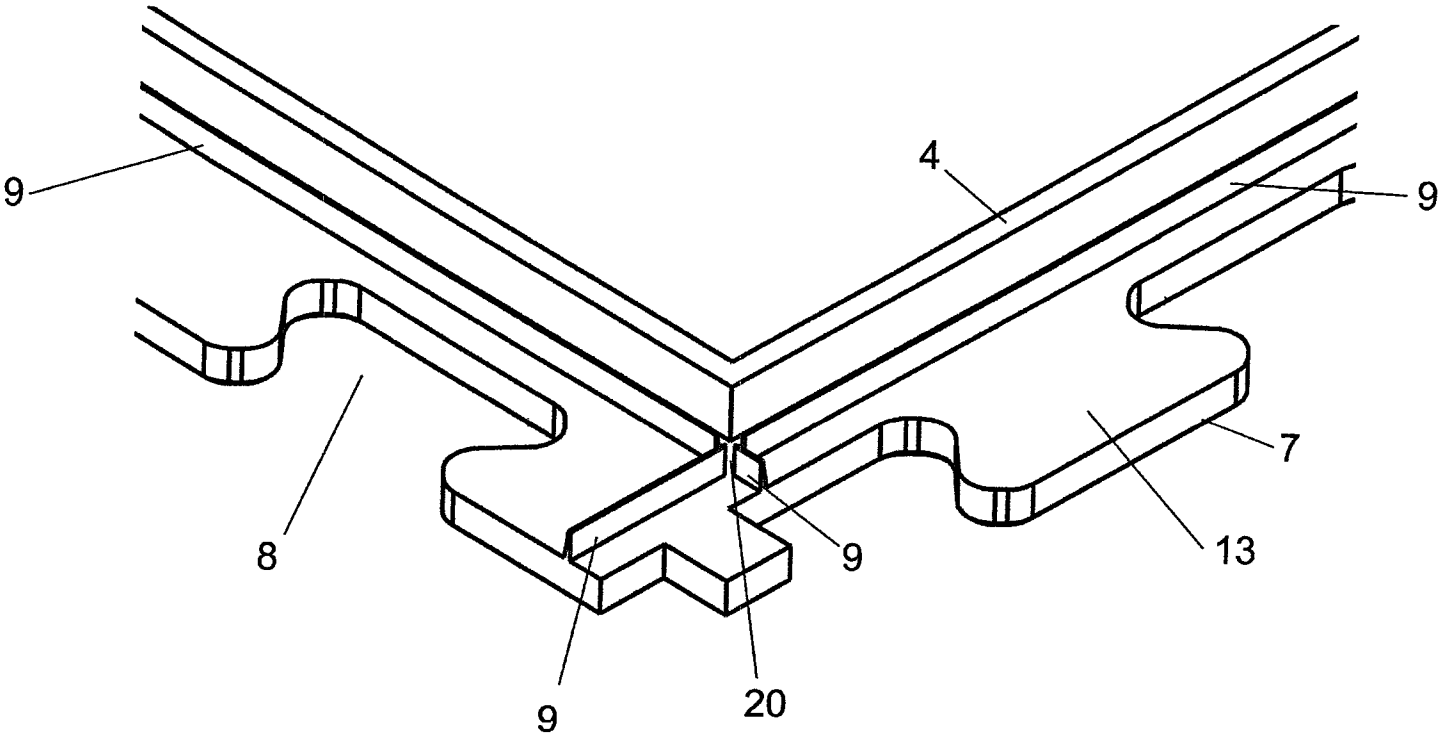
FIG. 4 is perspective view of corner A as shown in FIG. 1*b*.
Figure 5B:
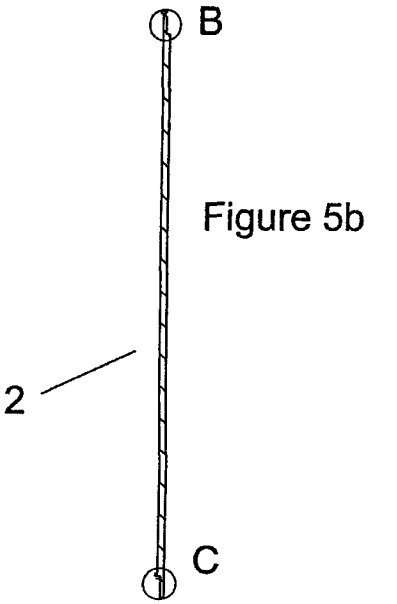
FIG. 5*b* is a cross-section view along line A-A of the base substrate in FIG. 5*a*.
Figure 5D:
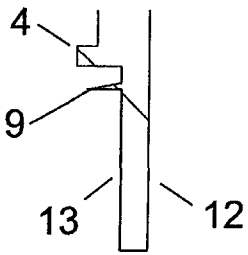
FIG. 5*d* is an enlarged view of end C of the cross-section in FIG. 5*b*.
Figure 5C:
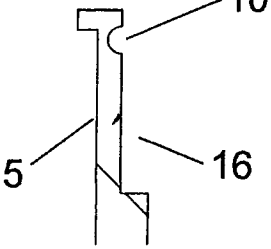
FIG. 5*c* is an enlarged view of end B of the cross-section in FIG. 5*b*.
Figure 5A:
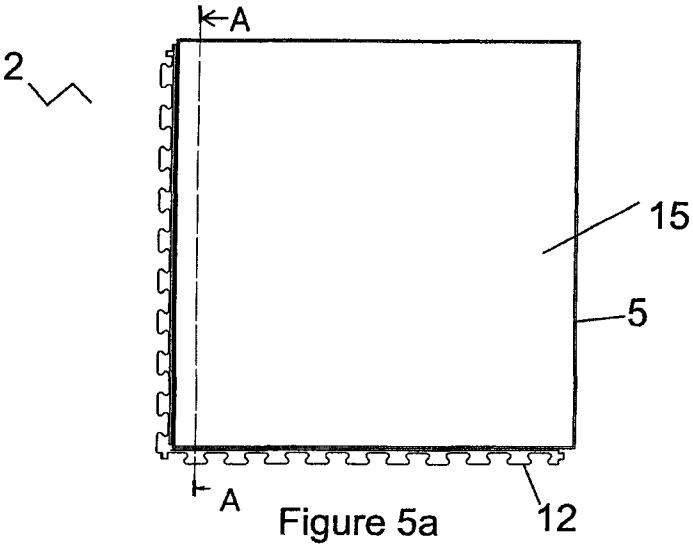
FIG. 5*a* is a plan view of the base substrate of the tile in FIG. 1*a*.
Figure 6:
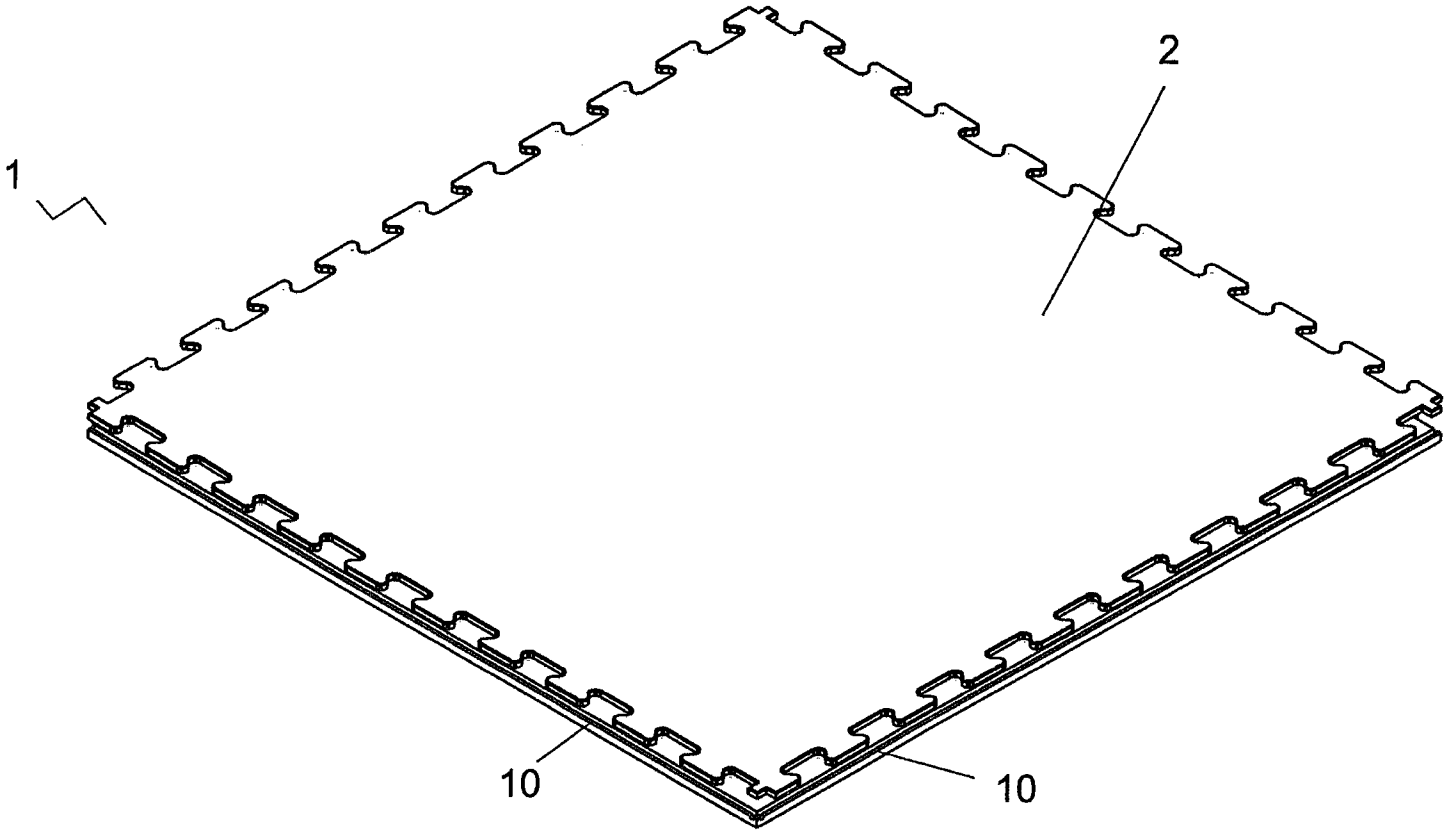
FIG. 6 is a bottom perspective view of the tile in FIG. 1*a*.
Figure 7B:
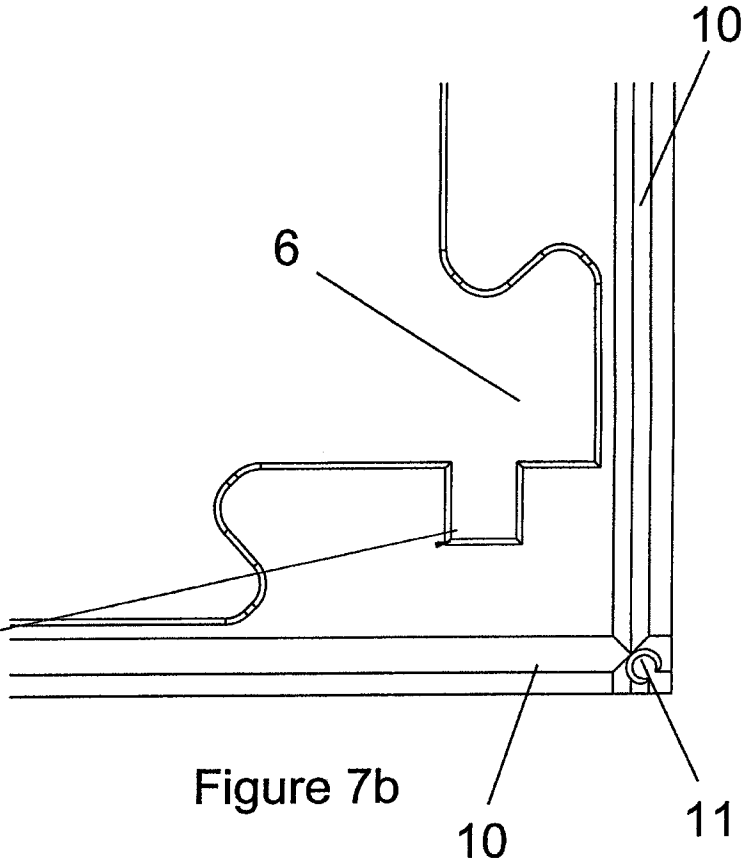
FIG. 7*b* is an enlarged view of corner D of the tile in FIG. 7*a*.
Figure 7A:
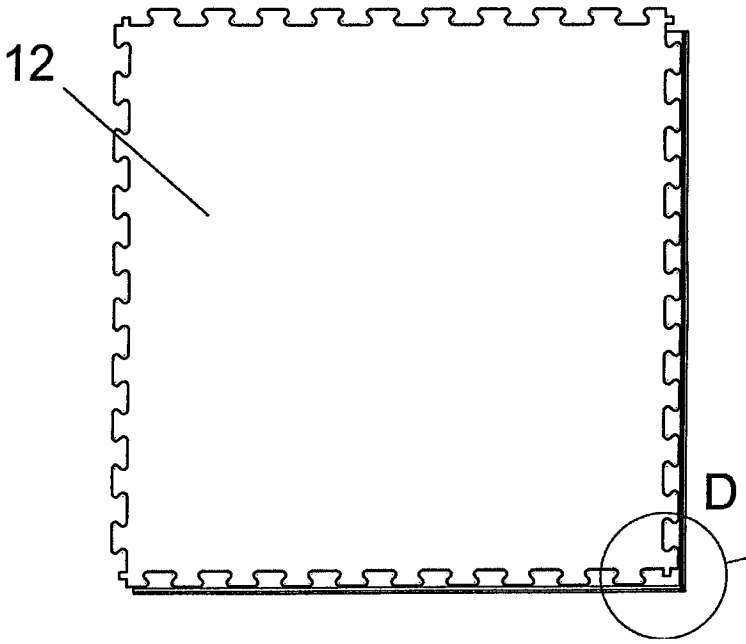
FIG. 7*a* is a bottom view of the tile in FIG. 1.
Figure 8A:
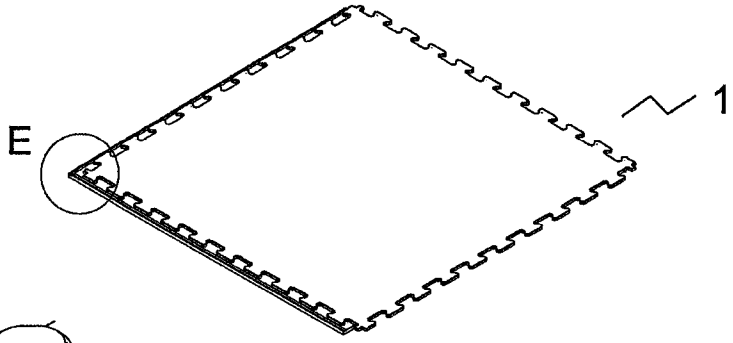
FIG. 8*a* is a bottom perspective view of the tile in FIG. 1*a*.
Figure 8B:
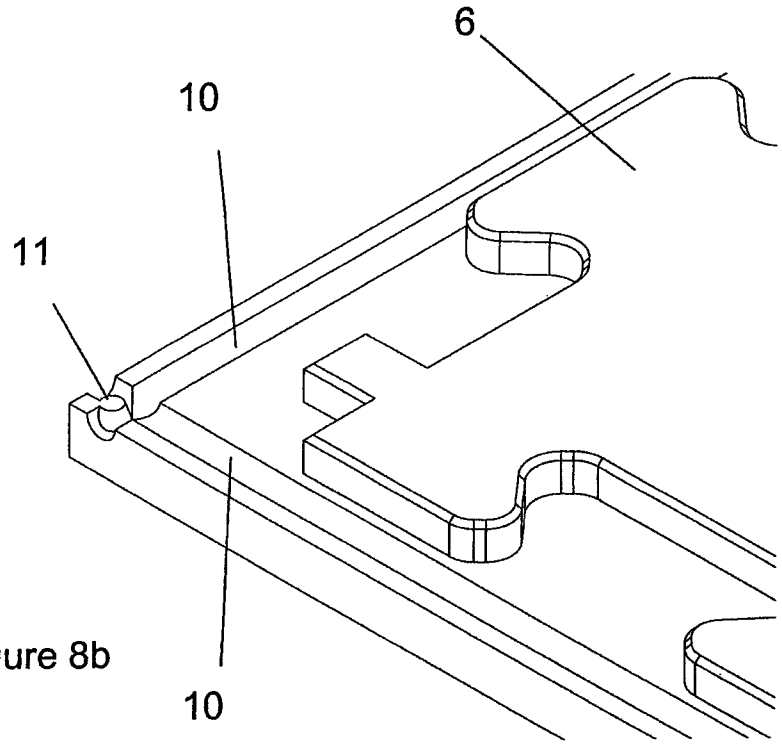
FIG. 8*b* is an enlarged perspective view of corner E of the tile in FIG. 8*a*.

As shown in FIGS. 1*b* and 4, each upstanding flexible seal fin 9 is of the same height and extends from top surface 13 of bottom layer 12 of base substrate 2 parallel to edge 4 such that it is shorter than the height of top layer 5 of base substrate 2, for example about half the height of laminate layer receiver 4, and does not touch top layer 5. Each upstanding flexible seal fin 9 is tapered such that the cross-section thereof is a right-angled triangle.

Upstanding flexible seal fins 9 are separated by gap 20 for receiving a truncated conical protrusion 11 of another tile, e.g., tile 1'.

Intersecting sealing channels 10 extend along the length of underside 16 of top layer 5 of base substrate 2. Each sealing channel 10 independently is for accepting two upstanding flexible seal fins 9, i.e., one upstanding flexible seal fin 9 from one further tile 1' and one upstanding flexible seal fin 9 from another further tile (not shown). In the embodiment shown in the drawings, each sealing channel 10 has a semi-circular cross section, the curved portion of which is about one and a half times to twice the length of the height of an upstanding seal fin 9. That is, the height of upstanding seal fin 9 is between about half and about three-quarters the length of the curved section of sealing channel 10.

Truncated conical protrusion 11 depends from sealing channels 10 adjacent the intersection point of sealing channels 10 such that protrusion 11 is flush with the underside 16 of top layer 5 of base substrate 2.

Figure 10A:
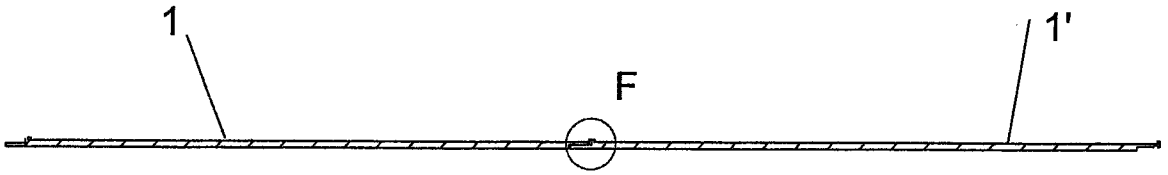
FIG. 10*a* is a cross-section view along line B-B of the interconnected base substrates in FIG. 9.

As shown in FIG. 10*a*, the portion of top layer 5 of base substrate 2 which extends over connecting means 6 of tile 1 will cover connecting means 6 and upstanding flexible seal fin 9 of adjacent tile 1' when tiles 1, 1' are interconnected. In this way, engaging connecting means 6 of adjacent tiles 1, 1' align and position edge 4 of tile 1 with edge 4 of adjacent tile 1' in a side by side arrangement. This provides a grout effect consisting of edges 4 of two interconnected tiles 1, 1'. Base substrate 2 may be made of any color as required to provide the required color for the grout effect.

For exemplary purposes, laminate layer 3 of tiles 1, 1' is excluded from FIGS. 5*a* to 5*d* and FIGS. 9, 10*a* and 10*b*. It should be understood that when tiles 1, 1' are being interconnected they may be done so with or without laminate layer 3 bonded to base substrate 2. Any number of tiles 1 may be joined to form a waterproof flooring system. That is, each join between tiles, whether between adjacent tiles or between diagonally placed tiles, does not permit water ingress.

Figure 9:
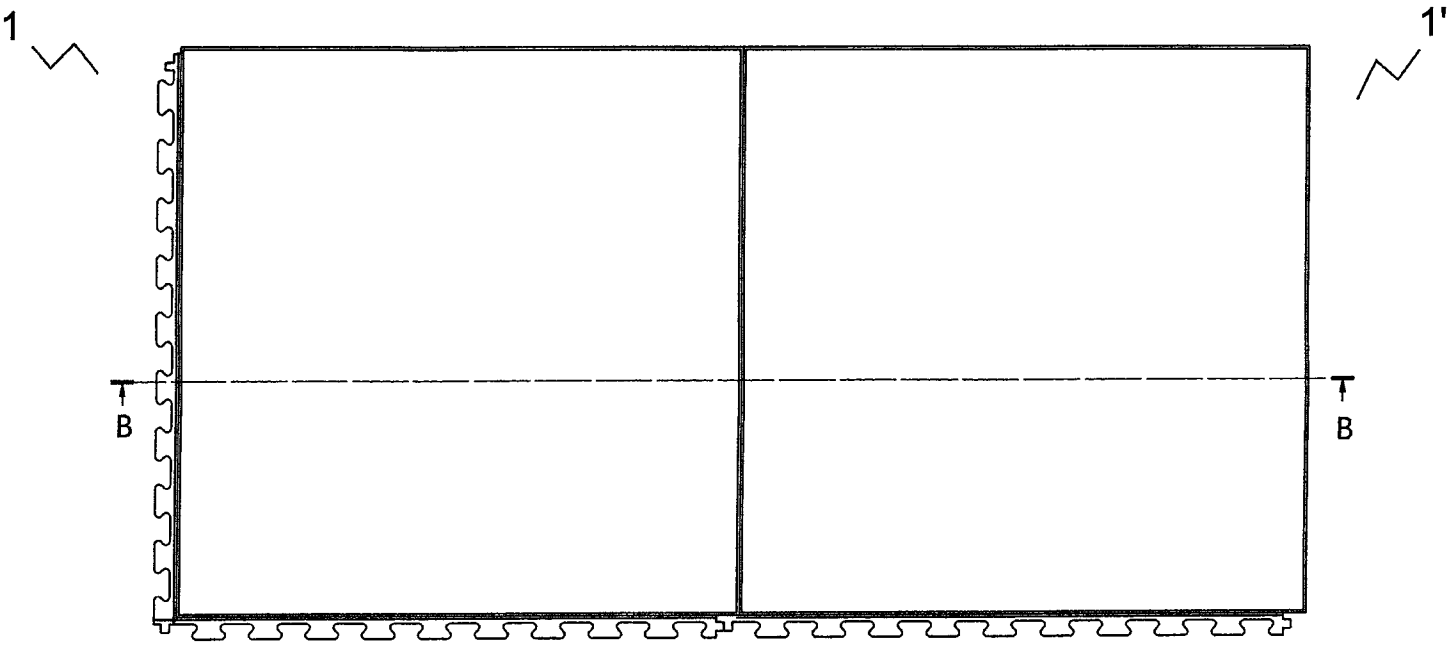
FIG. 9 is a plan view showing two base substrates of FIG. 5*a* interconnected.
Figure 10B:
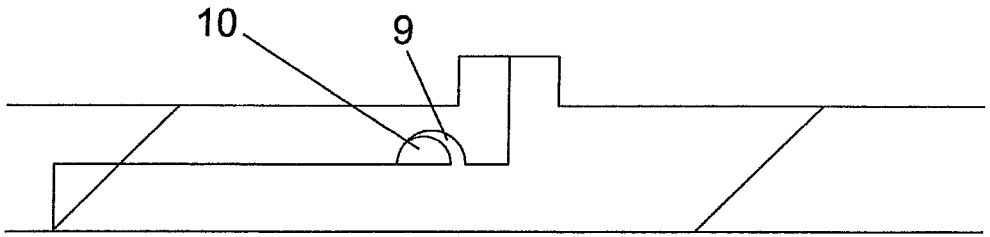
FIG. 10*b* is an enlarged view of the intersection F shown in FIG. 10*a*.

A protruding tongue 7 of base substrate 2 of one tile 1 is engaged in a groove 8 of base substrate 2 of another tile 1' to connect adjacent tiles 1, 1' to form a flooring system (see FIGS. 9 and 10).

As shown in FIGS. 9 and 10, upon connection of tiles 1 and 1', upstanding flexible seal fin 9 of tile 1 engages with sealing channel 10 of tile 1'. The position of upstanding flexible seal fin 9 relative to the centerline of sealing channel 10 forces upstanding flexible seal fin 9 to follow the curve of sealing channel 10 such that upstanding flexible seal fin 9 lies flush against the interior surface of sealing channel 10.

Upon connection of tiles 1, 1', and a third, fourth and fifth tile (not shown), upstanding flexible seal fin 9 of tile 1 engages with sealing channel 10 of tile 1', sealing channel 10 of tile 1 accepts an upstanding flexible seal fin 9 of a third tile (not shown) and truncated conical protrusion 11 of tile 1' engages with gap 20 in the upstanding flexible seal fins 9 of a fourth tile (not shown) to encourage the upstanding flexible seal fins 9 of the fourth tile into sealing channels 10 of tile 1, sealing channel 10 of the third tile (not shown) and sealing channel 10 of the fifth tile (not shown).

Base substrate 2 can be made of polyvinylchloride (PVC) such that the tiles provide ceramic aesthetics and vinyl performance.

Tile 1 is manufactured by forming a base substrate 2 having upstanding edges which define a laminate layer receiver 4 at a perimeter of top layer 5 of base substrate 2, connecting means 6, upstanding flexible seal fins 9, two intersecting sealing channels 10 and a truncated conical protrusion 11.

An injection moulding tool can be fitted to an injection moulding machine and appropriately operated to form base substrate 2. Base substrate 2 is then removed from the machine when formed and allowed to dry. Such a tool is fitted to the machine between the machine plates and secured using mould clamps. Flexible PVC in any of various colours is then vacuum fed to a hopper of the moulding machine and gravity feed into a barrel of the machine where it is melted at between approximately 180 to approximately 190° C. The injection moulding machine is set to allow a screw inside the barrel to pick up sufficient melted material that is then injected through a nozzle of the barrel and into the closed mould at pre-set speeds and pressures. The mould remains closed for a pre-set time to allow cooling. The mould then opens and the base substrate is manually or automatically ejected from the mould. This moulded interlocking base substrate 2 is then stacked on cooling racks for about 24 hours. It will be understood that the dimensions for the base substrate may be moulded as required or as desired.

Next, an adhesive is applied to a bottom surface of laminate layer 3. Such a step may be performed by operating a roller coater machine to apply adhesive to laminate layer 3. The adhesive may be a hot melt polyurethane adhesive or any other suitable adhesive and laminate layer 3 may comprise a PVC backing layer, a printed middle layer having a desired surface finish or effect for the tile 1, such as wood, porcelain, plastic etc. and a clear PVC top layer. Laminate layer 3 is sized as appropriate to sit in the laminate layer receiver on the base substrate.

Next, laminate layer 3 is oriented as required and placed into the laminate layer receiver of base substrate 2 and aligned within the rim 4 so that the bottom surface of laminate layer 3 sits on top layer 5 of base substrate 2. Pressure is then applied to laminate layer 3 on base substrate 2, such as by operating a nip-roller machine, so that laminate layer 3 is bonded to base substrate 2 to form tile 1. The completed interlocking tile 1 is then stacked flat on a cooling rack for a further 24 hours before packaging.

The tiles according to the invention have moulding grout edging thus providing ceramic aesthetics and vinyl performance as well as being completely waterproof, easy to install and reusable due to the fact they are not damaged upon removal.

It is to be understood that the invention is not limited to the specific details described herein which are given by way of example only and that various modifications and alterations are possible without departing from the scope of the invention as defined in the appended claims.

The terms "approximately"/"about" can be +/−10% of the amount referenced. Additionally, preferred amounts and ranges can include the amounts and ranges referenced without the prefix of being approximately.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A floor tile comprising a base substrate and a laminate layer, wherein the base substrate comprises:

a top layer with a laminate layer receiver on a top surface thereof; and a bottom layer with connecting means for engaging with connecting means of a base substrate of a further tile to form an interconnected flooring system, wherein the top layer of the base substrate extends over connecting means on at least one side of the base substrate, characterised in that the base substrate further comprises waterproofing means for engaging with waterproofing means of a base substrate of at least one further tile to provide a waterproof seal between the tile and at least one further tile, wherein the waterproofing means comprise:

at least one upstanding elongated flexible seal fin extending only from a top surface of the bottom layer of the base substrate;

a sealing channel located only on the underside of the top layer of the base substrate; and a protrusion extending from the underside of the top layer of the sealing channel, wherein the upstanding flexible seal fin is for engaging with the sealing channel of a further tile, wherein the sealing channel is for accepting an upstanding flexible seal fin of at least one other further tile and wherein the protrusion is for engagement with yet a further tile to encourage the upstanding flexible seal fin of the tile with which it engages into a sealing channel of one of the other tiles.

2. The tile of claim 1, wherein the laminate layer receiver comprises upstanding edges defining a rim at a perimeter of the top layer of the base substrate for aligning the laminate layer on the base substrate.

3. The tile of claim 2, wherein the rim of the laminate layer receiver extends around the full perimeter of the top layer of the base substrate.

4. The tile of claim 1, wherein the connecting means comprises a plurality of protruding tongues and grooves at adjacent sides of the bottom layer of the base substrate.

5. The tile of claim 1, wherein the top layer of the base substrate extends over connecting means on two adjacent sides of the base substrate.

6. The tile of claim 5, wherein the tile has four upstanding flexible seal fins separated by a gap for receiving the protrusion of another tile.

7. The tile of claim 1, wherein the upstanding flexible seal fin extends from the top surface of the bottom layer such that it does not touch the top layer of the base substrate.

8. The tile of claim 1, wherein the tile has a plurality of upstanding flexible seal fins which do not touch each other.

9. The tile of claim 1, wherein each upstanding flexible seal fin independently is tapered.

10. The tile of claim 1, wherein each upstanding flexible seal fin independently is tapered such that the cross-section thereof is a triangle.

11. The tile of claim 1, wherein each upstanding flexible seal fin independently is shorter than a height of the top layer of the base substrate.

12. The tile of claim 1, wherein the sealing channel extends along length of the tile.

13. The tile of claim 1, wherein the tile has two intersecting sealing channels.

14. The tile of claim 1, wherein the tile has two intersecting sealing channels and wherein the protrusion is located offset from the intersection point of the two sealing channels.

15. The tile of claim 1, wherein a portion of the cross section of each sealing channel independently is curved.

16. The tile of claim 1, wherein the protrusion is a tapered protrusion.

17. The tile of claim 1, wherein the protrusion depends from the sealing channel such that a top of the protrusion spud is flush with an underside of the top layer of the base substrate.

18. The tile of claim 1, wherein the base substrate of the tile is made of polyvinylchloride (PVC).

19. A floor tile with waterproof connections, comprising:

a base substrate and a laminate layer, wherein the base substrate includes:

a top layer with a laminate layer receiver on a top surface thereof;

a bottom layer with connecting means for engaging with connecting means of a base substrate of a further tile to form an interconnected waterproof flooring system, wherein the top layer of the base substrate extends over connecting means on at least one side of the base substrate;

a waterproofing means for engaging with waterproofing means of a base substrate of at least one further tile to provide a waterproof seal between the tile and at least one further tile, the waterproofing means includes:

a plurality of elongated flexible seal fins extending only from a top surface of the bottom layer of the base substrate;

a plurality of sealing channels located only on the underside of the top layer of the base substrate; and a protrusion extending from the underside of the top layer of the base substrate of the sealing channel, wherein the upstanding flexible seal fin is for engaging with the sealing channel of a further tile, wherein the sealing channel is for accepting an upstanding flexible seal fin of at least one other further tile and wherein the protrusion is for engagement with yet a further tile to encourage the upstanding flexible seal fin of the tile with which it engages into a sealing channel of one of the other tiles.

20. The floor tile of claim 19, wherein the plurality of elongated flexible seal fins includes at intersecting flexible seal fins with a gap between the intersecting flexible fins, and the gap is for receiving the protrusion of the further tile.

* * * * *